US011046495B2

(12) United States Patent
Vaucher

(10) Patent No.: US 11,046,495 B2
(45) Date of Patent: Jun. 29, 2021

(54) SPOUT WITH FINAL ZONE

(71) Applicant: SMIXIN SA, Bienne (CH)

(72) Inventor: Vincent Vaucher, Sonceboz-Sombeval (CH)

(73) Assignee: SMIXIN SA, Bienne (CH)

( * ) Notice: Subject to any disclaimer, the term of this patent is extended or adjusted under 35 U.S.C. 154(b) by 0 days.

(21) Appl. No.: 16/631,200

(22) PCT Filed: Jul. 20, 2018

(86) PCT No.: PCT/EP2018/069851
§ 371 (c)(1),
(2) Date: Jan. 15, 2020

(87) PCT Pub. No.: WO2019/016403
PCT Pub. Date: Jan. 24, 2019

(65) Prior Publication Data

US 2020/0216248 A1 Jul. 9, 2020

(30) Foreign Application Priority Data

Jul. 21, 2017 (EP) ..... 17182659

(51) Int. Cl.
*B65D 5/74* (2006.01)
*B65D 47/10* (2006.01)
(Continued)

(52) U.S. Cl.
CPC ..... *B65D 75/5883* (2013.01); *B65D 5/74* (2013.01); *B65D 47/106* (2013.01); *A47K 5/12* (2013.01);
(Continued)

(58) Field of Classification Search
CPC .... B65D 75/5883; B65D 5/74; B65D 47/106; B65D 83/0055; B65D 2251/04;
(Continued)

(56) References Cited

U.S. PATENT DOCUMENTS 8,668,400 B2 * 3/2014 Ecker ..... B65D 51/225 401/134
8,720,744 B2 * 5/2014 Barron ..... B67B 7/26 222/83

(Continued)

FOREIGN PATENT DOCUMENTS

| | | |
|---|---|---|
| EP | 1 829 818 | 9/2007 |
| FR | 2 431 441 | 2/1980 |
| WO | 2014/103574 | 7/2014 |

OTHER PUBLICATIONS

International Preliminary Report on Patentability dated Jan. 21, 2020, Application No. PCT/EP2018/069851; 12 pages.

*Primary Examiner* — Frederick C Nicolas
(74) *Attorney, Agent, or Firm* — Rankin, Hill & Clark LLP

(57) ABSTRACT

A spout for a container, wherein the spout includes a spout body and a spout counterpart. The spout body has a first zone, and the spout counterpart has a final zone. In the final position of the spout, an outlet opening arranged on the spout is open, providing a liquid communication through the spout body to and through the outlet opening. The final zone features a first subzone and a second subzone, arranged free of mutual overlap, allowing the spout to be arranged in its final position in two different configurations: a first configuration of the final position, where a reference subzone of the first zone is arranged to physically interact with the first subzone, and a second configuration of the final position, where the reference subzone is arranged to physically interact with the second subzone.

13 Claims, 5 Drawing Sheets

(51) Int. Cl.

| | |
|---|---|
| ***B65D 75/58*** | (2006.01) |
| *A47K 5/12* | (2006.01) |
| *B65D 83/00* | (2006.01) |
| *B65D 41/06* | (2006.01) |
| *B65D 77/06* | (2006.01) |
| *B65D 47/38* | (2006.01) |

(52) U.S. Cl.
CPC ..... *B65D 41/06* (2013.01); *B65D 47/38* (2013.01); *B65D 77/06* (2013.01); *B65D 83/0055* (2013.01); *B65D 2251/04* (2013.01)

(58) Field of Classification Search
CPC ..... B65D 77/06; B65D 41/06; B65D 47/38; A47K 5/12
See application file for complete search history.

(56) References Cited

U.S. PATENT DOCUMENTS

| | | | | |
|---|---|---|---|---|
| 9,850,040 | B2 * | 12/2017 | Scott | B01L 3/502 |
| 10,093,459 | B2 * | 10/2018 | Ikegami | B65D 47/38 |
| 2006/0201967 | A1 | 9/2006 | Romer | |
| 2010/0102086 | A1 | 4/2010 | Rabinovitch | |
| 2017/0096273 | A1 | 4/2017 | Mazurkiewicz et al. | |
| 2017/0197762 | A1 | 7/2017 | Ikegami | |

* cited by examiner

SPOUT WITH FINAL ZONE

BACKGROUND OF THE INVENTION

Field of the Invention

The invention relates to the field of spouts for container. Content of the container can leave the container through the spout. In other words, a spout can be used to release the content of a container from the container.

Description of Related Art

Spouts are found in many variants on different kinds of containers for various applications. For example, spouts on containers for beverages or food products, or spouts for containers with construction material as paint or lacquer. Spouts can, for example, also be found on containers for cosmetics and toiletries.

For example, a dispenser for containing and dispensing a liquid or pourable solid product is described in US 2010/0102086. A fluid container with a nozzle body attached to a support body is shown in US 2017/0197762. A pouring structure for a refill container is shown in WO 2014/103574.

Spouts can be used on containers containing liquids. Spouts are, for example, also used on containers containing any type of fluids. Spouts can, for example, be used on containers with solid content. Also mixtures of fluid and solid contents are possible. The content of the container might be in any physical state, i.e., in any state of aggregate and/or mixture of physical states.

A spout can be arranged to cooperate with a specific receptacle in a manner which allows to transfer the content of the container through the spout to the receptacle. In order to cooperate with the specific receptacle, the spout can feature specific properties as, for example, a specific shape, a specific size and/or a specific connector part.

Especially if a known spout is arranged to cooperate with a specific receptacle, then each spout is specifically produced. But also spout not being arranged to cooperate with a specific receptacle in many cases vary for different application. Therefore, different spouts have to be produced for each different application. The production of known spouts is expensive since the spout features vary with each type of spout, i.e., with each application and spouts therefore have to be specifically produced. Also a replacement of a spout can be difficult if spouts exist in a large variety.

Since many different spouts exist, not all spouts are suitable for all applications. Most known spouts are suitable for only one or only a few applications. The use of known spouts is therefore limited, and in consequence also the use of containers featuring such a known spout is limited. Even if the same type container content is to be used, but different spouts are needed, then the same container content has to be prepared in multiple containers of the same type but featuring different spouts. For this reason, production, storage and logistics of known spouts and containers with such spouts are complicated and expensive.

Furthermore, if different spouts can be used for the same application, then it is possible that containers with contents not foreseen for this application can be used—as long as a suitable type of spout is used. This is potentially dangerous and can lead to misuse and accidents. Also a quality control or a quality guarantee are hard to implement under these circumstances. The same problems arise if one single type of spout is used on a variety of containers with different content.

Another problem of known spouts is safety. Manipulations of spouts are done for many reasons. For example, the container content can be manipulated, or partially or as a whole removed and/or replaced. Or spouts are manipulated in order to make them suitable for applications not foreseen. The disadvantages are the same as in the paragraph above: use of manipulated spouts is potentially dangerous and can lead to misuse and accident. Also quality control and a quality guarantee are difficult to implement.

SUMMARY OF THE INVENTION

It is therefore an object of the invention to create a spout which overcomes at least one of the disadvantages mentioned above at least partially.

A first aspect of the invention relates to a spout for a container, the spout including a spout body and a spout counterpart. The spout body features a container fastening part, and the spout body includes a first zone being an integral part undetachable from the spout body. The spout counterpart includes a final zone being an integral part undetachable from the spout counterpart. The spout body and the spout counterpart are spatially arrangeable with respect to each other in a final position of the spout, wherein in the final position of the spout, the first zone of the spout body is arranged to physically interact with the final zone of the spout counterpart, and wherein in the final position of the spout, an outlet opening arranged on the spout is open, providing a liquid communication through the spout body to and through the outlet opening. The spout features a final configuration stopper, and the final zone of the spout counterpart features a first subzone and a second subzone. The first subzone is arranged free of mutual overlap with the second subzone, allowing the spout to be arranged in its final position in two different configurations:

- a first configuration of the final position, where a reference subzone of the first zone of the spout body is arranged to physically interact with the first subzone of the final zone of the spout counterpart, and the final configuration stopper is arranged to provide physical resistance against a movement of the reference subzone of the first zone of the spout body from the first subzone of the final zone of the spout counterpart to the second subzone of the final zone of the spout counterpart, and
- a second configuration of the final position, where the reference subzone of the first zone of the spout body is arranged to physically interact with the second subzone of the final zone of the spout counterpart, and the final configuration stopper is arranged to provide physical resistance against a movement of the reference subzone of the first zone of the spout body from the second subzone of the final zone of the spout counterpart to the first subzone of the final zone of the spout counterpart.

The container can be built from one or multiple materials. The container can, for example, be built from plastic. The container can also be built from glass, ceramics, paper, cardboard, wood, metal and/or composite material. The container can be built of a combination of the materials mentioned above. The container can be arranged to be flexible if empty, partially and/or fully filled with its content. The container is, for example, flexible when empty and less flexible the more the container is filled. Or the container can be arranged to keep its shape if empty, partially and/or fully filled with its content. In this case, the container features a rigid construction. The container can also be at least partially flexible if empty, partially and/or fully filled.

The container is optionally impermeable for liquids. Optionally, the content of the container can only leave the container through the spout.

The container fastening part of the spout body is arranged to mount the spout on the container. The fastening part can, for example, be arranged as an area on the spout body where the spout is welded to the container, especially in the case of plastic containers.

Optionally, the spout is fastened irreversibly to the container via the container fastening part.

Zones as, for example, the first zone or the final zone designate specific and spatially fixed areas on the components. Any subzone of a certain zone is a specific and spatially fixed area comprised by the certain zone.

The physical resistance of the final configuration stopper is realized as a threshold to be overcome. The height of the threshold can be defined and can specifically be set for a specific application. The final configuration stopper can, for example, be destroyed once the physical resistance is overcome. The final configuration stopper can be realized in a manner that it is not destroyed once the physical resistance is overcome.

The physical resistance can, for example, be provided by a final configuration stopper arranged to work like a snap lock or a ratchet. The final configuration stopper can provide the physical resistance due to elastic deformation of an element of the final configuration stopper. The final configuration stopper can provide the physical resistance due to inelastic deformation of an element of the final configuration stopper. Also a combination of elastic and inelastic deformations can provide the physical resistance of the final configuration stopper.

The spout features two parts (spout body and spout counterpart) that can be arranged in their final position with respect to each other in two different configurations. In each of these two configurations of the final position, the outlet opening is open, providing the liquid communication through the spout. The outlet opening can be understood as a channel through the spout providing liquid communication through the spout between an inside of the container and an end of the outlet opening. Once the spout is in one configuration of the final position, the final configuration stopper hinders the spout to get into the other configuration of the final position.

The same spout can be brought into two different configurations. These configurations differ in the spatial arrangement of the spout body relative to the spout counterpart. The spout as a whole features in its final position two different configurations, and these configurations can differ from each other for example with regard to shape, size and/or connector parts respectively the spatial arrangement of the connector parts.

The two configurations of the spout in its final position can differ from each other with regard to shape.

The two configurations of the spout in its final position can differ from each other with regard to size.

The two configurations of the spout in its final position can differ from each other with regard to connector parts respectively the spatial arrangement of the connector parts.

For example, the spout counterpart can be shaped asymmetrically with regard to a longitudinal axis of the spout counterpart, or feature one or more connector parts distributed asymmetrically—with regard to a longitudinal axis of the spout counterpart—on the spout counterpart. The first configuration can, for example, differ from the second configuration by being rotated around the longitudinal axis of the spout counterpart. In other words, a position of an element on the spout counterpart relative to the spout body when the spout is in the first configuration is rotated in comparison with the position of this element relative to the spout body when the spout is in the second configuration. The spout could then—analogue to a key—fit a receptacle either in the first or the second configuration, but still offer the possibility to be configured in either of the configurations. One such spout fits two different specific receptacles due to the two possible different configurations.

Such a spout can be therefore configured in two different configurations, which may suit different applications. One spout can be used for two different applications. Instead of producing, storing and keeping ready two different types of spouts, only one type of spout with two different configurations can be used, i.e. produced, stored and kept ready. This is cost efficient and simple.

Since two different configurations are possible, the spout is versatile. One spout (and in consequence also a container with this one spout) can be used for different applications.

Safety and quality control can be achieved with this spout because of the two different configurations: for example, only correctly configured spouts can cooperate with according receptacles. But only one specific of the two configurations might be suitable for an application without knowing it beforehand (or without knowing it at all—the choice of configuration might, for example, happen in an imperceptible manner), so providing suitable alternative spouts on unintended containers—for example with unintended content—is difficult. Safety and quality control are enhanced this way. Tampering with the spout is therefore also more tedious and/or difficult.

The spout can feature at least two different configurations. The spout can for example feature 3 configurations. The spout can also feature 4, 5 or 6 configurations. The advantages described above apply accordingly.

The final configuration stopper is provided by the spout body and/or the spout counterpart. The final configuration stopper can include one element or multiple elements. These final configuration stopper elements can be arranged spatially separated from each other or can be arranged together in groups with the groups being spatially separated from each other.

As an optional feature, the difference between the first and the second configuration of the spout in its the final position is a rotational orientation of the spout counterpart relative to the spout body with regard to an axis oriented mainly along a flow direction of the liquid communication through the spout. In other words, the spout counterpart in the first configuration is rotated (around the flow axis of the outlet opening) with respect to the second configuration.

Such a difference in rotational orientation is easy to implement. It can induce a large effect to the configuration of the spout.

For example, the first configuration is rotated about 90 degrees with respect to the second configuration. A rotation of multiples of 90 degrees is also possible. Optionally, a rotation of 30 degrees or one or more multiples of 30 degrees is chosen. Also a rotation of 72 degrees or one or more multiples of 72 degrees is possible.

As a further optional feature, the spout includes only the spout body and the spout counterpart. This means that the spout features no additional parts besides the spout body and the spout counterpart. The small number of parts renders the production easy and cheap.

As another optional feature, the spout in final position is arranged such that the first zone is arranged to physically interact only with the final zone. In other words, the first zone of the spout body fully overlaps (with respect to physical interaction) with the final zone of the spout counterpart in the final position of the spout. No part of the first zone is able to physically interact with elements outside the final zone.

As an optional feature, the spout features a final zone stopper, which is arranged to provide physical resistance against a movement of the reference subzone of the first zone of the spout body beyond the final zone of the spout counterpart, if the spout is in its final position.

The final zone stopper can be realized similar to the final configuration stopper.

The final zone stopper prevents a movement of the spout away from the final position once it got into its final position.

As an optional feature, with the spout in its final position, the spout is arranged to provide physical resistance against any movement of the reference subzone of the first zone of the spout body beyond the final zone of the spout counterpart.

In other words, the spout is locked in the final position. This has the advantage that the spout cannot be tampered with after being brought in its final position.

In combination with the final configuration stopper, the final zone stopper can ensure that the chosen configuration is final once the spout has been brought into its final position.

The spout can also be realized free of a final zone stopper.

As an optional feature, the first zone of the spout body and the final zone of the spout counterpart feature guiding components defining a helical movement path of the spout body relative to the spout counterpart in a movement into the final position of the spout.

In other words, the guiding components have an effect like a thread and allow the spout body and the spout counterpart to move into the final position in a screwing-like movement. Moving into the final position means a movement of the reference subzone from outside the final zone to inside the final zone.

Alternatively, the spout can feature guiding components defining a linear movement path. Or the spout can be realized free of guiding elements.

Optionally, the spout features a spout seal arranged at the spout to prevent the fluid communication to and/or through outlet opening at least until the spout has been in its final position at least once.

The spout seal can be arranged on spout body and/or on the spout counterpart. The spout seal ensures that the fluid communication through the outlet opening is sealed before the spout has been in its final position at least once. The spout seal prevents spillage of the container content before the spout has been brought into its final position. The spout seal also prevents tampering with the container contents before the spout has been brought into its final position. The spout seal can prevent that the container content gets contaminated and/or gets in touch with air or other substances. By sealing the spout with the spout seal, the container can be sealed and in consequence also its content can be sealed.

The spout can, for example, also feature a spout seal opener. The spout seal opener can be arranged on the spout counterpart, for example when the spout seal is arranged on the spout body. Also an arrangement with spout seal on the counterpart and spout opener on the spout body is possible.

Alternatively, the spout can be realized free of spout seal and/or spout seal opener.

Optionally, the spout counterpart features a functional element in fluid communication with the outlet opening of the spout counterpart. The functional element is arranged downstream of the outlet opening with regard to a stream direction of the fluid communication from the spout body to the outlet opening. The functional element, in the final position of the spout, is arranged to influence the liquid communication downstream of the outlet opening.

To influence the liquid communication means to interact with the liquid communication. It means for example an interaction with a content from the container released through the spout, for example by adding a substance, retaining a part of the content, applying a pressure to the content and/or changing the temperature of the content.

The functional element adds versatility to the spout. The spout can fulfill an additional function. The spout is therefore not easy to replace or to be tampered with, which enhances safety and quality control.

Alternatively, the functional element can be arranged upstream of the outlet opening.

As an optional feature, the functional element is arranged to add a substance into the liquid communication in the final position of the spout.

Adding a substance into the liquid communication results in mixing the substance into the container content in the liquid communication. The added substance is, for example, a liquid. In one embodiment, the added substance is a liquid (for example, water) and the container content is also a liquid (for example, a liquid soap). It is possible that more than one substance is added. For example, water and air can be added by the functional element to the container content, which can be a liquid such as, for example, liquid soap.

Optionally, the functional element is a mixing unit including a liquid duct in liquid communication with the liquid communication through the spout, a diluent inlet with a diluent duct and a mixing chamber for mixing the liquid with the diluent, wherein the diluent duct is positioned relatively to the liquid duct for the diluent stream to intersect the liquid stream before or at the mixing chamber.

A mixing unit with these (and more) features is for example described in the patent application EP1829818A2. According advantages do also apply for the spout including this mixing unit.

Alternatively, the spout is realized free of a functional element.

As an optional feature, the spout counterpart includes a loading zone. The loading zone is an integral part undetachable from the spout counterpart. The spout body and the spout counterpart are spatially arrangeable with respect to each other in a loading position of the spout. In the loading position of the spout, the first zone of the spout body is arranged to physically interact with the loading zone of the spout counterpart. And in the loading position of the spout, the reference subzone of the first zone of the spout body is able to be repositioned from a first position in the loading zone leading to the first configuration of the final position to a second position in the loading zone leading to the second configuration of the final position.

The loading zone of the spout counterpart optionally is arranged free of mutual spatial overlap with the final zone.

The loading zone of the spout counterpart, for example, is arranged spatially at least partially overlapping with the final zone with this spatial overlap area temporally exclusively either being part of the loading zone or of the final zone.

In other words: the overlap area of the spout counterpart can spatially be at least a part of the loading zone or at least a part of the final zone, but depending on a condition or state of the barrier, the overlap area is either a part of the loading zone or a part of the final zone (i.e., temporally changing from loading zone to final zone).

For example, when the barrier provides no resistance anymore after changing the spout from its loading position to its final position once, then before the barrier has been crossed by the reference area, a certain area of the spout counterpart belongs to the loading zone, and after the barrier has been crossed, this area belongs to the final zone since the reference area can return to it without any resistance from the barrier.

In the loading position, the spout body can be moved from a first position relative to the spout counterpart, which eventually leads to the first configuration of the final position, to a second position relative to the spout counterpart, which eventually leads to the second configuration of the final position.

Optionally, when the spout is in loading position, the reference subzone of the first zone of the spout body is able to be repositioned from the second position in the loading zone leading to the second configuration of the final position to the first position in the loading zone leading to the first configuration of the final position.

As an optional feature, the loading zone is arranged adjacent to the final zone.

Due to the loading zone, the spout can be prepared for ending up in either the first or the second configuration in the final position of the spout, and to change between these preparation states. The loading zone allows to choose easily which configuration the spout will end in when the spout is brought into its final position.

Alternatively, the spout is realized free of a loading zone.

Optionally, the spout features a barrier arranged along a movement path of the spout body from the loading position to the final position, and the barrier is arranged to provide physical resistance against a movement of the spout body from the loading position to the final position at least until the spout has been in its final position at least once.

The barrier prevents the spout to be brought into its final position unwillingly. The barrier keeps the spout in the loading position unless the physical resistance of the barrier is overcome. The barrier prevents, for example, the spout seal to be broken before it is wished to do so.

The barrier is, for example, a protrusion of the spout body arranged to interact with a protrusion of the spout counterpart. The barrier can be realized similar to the final configuration stopper and/or the final zone stopper.

Alternatively, the spout can be realized free of a barrier.

Optionally, the spout features a loading zone stopper which, if the spout is in its loading position, is arranged to provide physical resistance against a movement of the reference subzone of the first zone of the spout body beyond the loading zone of the spout counterpart—but as only exception, the loading zone stopper is arranged to provide no physical resistance against a movement from the loading zone to the final zone.

The loading zone stopper can be realized similar to the barrier, the final configuration stopper and/or the final zone stopper. The loading zone stopper works similar to the final zone stopper and has the analogue advantages. The loading zone stopper prevents a movement of the spout away from the loading position—except for the movement from the loading zone to the final zone.

Alternatively, the spout can be realized free of loading zone stopper.

As an optional feature, the barrier is arranged to provide a physical resistance against a movement that is lower than the physical resistance of the loading zone stopper.

In other words: it is easier to overcome the barrier than it is to overcome the loading zone stopper. This way, a movement can be executed strong enough to move the spout from the loading position to the final position but still not strong enough to move the spout away from the loading position in any other direction than the final position.

Alternatively, the physical resistance provided by the barrier and provided by the loading zone stopper can be the same. Or the physical resistance provided by the barrier and is larger than the one provided by the loading zone stopper.

As an optional feature, if the spout is in its loading position, the spout is arranged to provide physical resistance against any movement of the reference subzone of the first zone of the spout body beyond the loading zone of the spout counterpart, with the exception of a movement from the loading zone to the final zone.

In this case, any movement away from the loading zone is prevented unless the movement to the final zone. This can, for example, be achieved by a combination of the final zone stopper with other features on spout body and/or spout counterpart that hinder the reference subzone to leave the final zone.

In one embodiment, due to a combination of to the loading zone stopper and the barrier and possibly other elements, a movement of the spout away from the loading position i.e. beyond the loading position is always restricted by physical resistance and for example only possible towards final zone i.e. towards the final position by overcoming the barrier.

Optionally, the spout features a loading configuration stopper, and the loading zone of the spout counterpart features a first subzone and a second subzone, the first subzone of the loading zone being arranged free of mutual overlap with the second subzone of the loading zone, allowing the spout to be arranged in its loading position in two different loading configurations:

- a first loading configuration of the loading position, where the reference subzone of the first zone of the spout body is arranged to physically interact with the first subzone of the loading zone of the spout counterpart, and the loading configuration stopper is arranged to provide physical resistance against a movement of the reference subzone of the first zone of the spout body from the first subzone of the loading zone of the spout counterpart to the second subzone of the loading zone of the spout counterpart, and
- a second loading configuration of the loading position, where the reference subzone of the first zone of the spout body is arranged to physically interact with the second subzone of the loading zone of the spout counterpart, and the loading configuration stopper is arranged to provide physical resistance against a movement of the reference subzone of the first zone of the spout body from the second subzone of the loading zone of the spout counterpart to the first subzone of the loading zone of the spout counterpart, wherein the spout in the first loading configuration of the loading position is arranged to be moved to the first configuration of the final position if overcoming the physical resistance of the barrier, and is arranged to be prevented to be moved to the second configuration of the final position if overcoming the physical resistance of the barrier.

In other words: the spout features optionally two different loading configurations when in the loading position. These two loading configurations are defined by two subzones in the loading zone, which are separated by loading configuration stopper and which are linked to the two different configurations of the final zone.

The loading configuration stopper can be realized similar to the loading zone stopper, the barrier, the final configuration stopper and/or the final zone stopper. The according advantages and effects apply in an analogue manner. For example, the final configuration stopper can be similar to the loading configuration stopper.

Optionally, the spout includes a loading zone barrier.

The loading zone barrier works similar to the barrier: the barrier provides a physical resistance to the spout in the loading position when trying to move into (i.e., trying to change into) the final position, whereas the loading zone barrier provides a physical resistance to the spout in the loading position and outside first and second subzones of the loading zone when trying to move into the first or second subzone of the loading zone. The loading zone barrier can be realized similar to the barrier, the loading configuration stopper, the final configuration stopper and/or the final zone stopper. The according advantages and effects apply in an analogue manner.

All stoppers, guiding elements as well as the barrier described above can be either realized as one or multiple specific elements of the spout with only this single function. Or the stoppers, guiding elements and/or the barrier can be combined functions of one or multiple elements of the spout.

For example, a hook like element of the spout can have the combined function of a guiding element at one side of the element while at the same time have the function of a loading configuration stopper at another side. Even the same side can have combined functions at the same time, for example as a guiding element as well as a final zone stopper. Or as another example, multiple separate elements of the spout can only have the single function of a barrier.

This way, the spout can be prepared for specifically one of the two configurations. Depending on the physical resistance of the loading configuration stopper, a change from the first loading configuration to the second loading configuration is not possible or possible with a chosen threshold of force overcoming the physical resistance of the loading configuration stopper.

Such a spout can initially be prepared for either one of the loading configurations, leading to one specific configuration in the final position, with or without to change the loading configuration. One spout can therefore be used for different, exclusive applications (i.e. different configurations in the final position). The according advantages regarding versatility, production, costs, quality control and tamper evidence have already been described.

The features and advantages described above regarding the final configuration stopper can be applied in an analogue manner to the loading configuration stopper. For example, at least two different loading configurations are possible. Also 3, 4, 5 or more loading configurations are possible.

Optionally, the physical resistance of the loading configuration stopper is larger than the physical resistance of the barrier.

A second aspect of invention relates to a spout for a container, wherein the spout includes a spout body and a spout counterpart. The spout body features a container fastening part. The spout body includes a first zone being an integral part undetachable from the spout body, and the spout counterpart includes a loading zone and a final zone. Both loading zone and final zone are integral parts undetachable from the spout counterpart, and the spout body and the spout counterpart are spatially arrangeable with respect to each other in a loading position of the spout, wherein the first zone of the spout body is arranged to physically interact with the loading zone of the spout counterpart, and wherein the first zone of the spout body is spatially separated from the final zone of the spout counterpart, and in a final position of the spout, wherein the first zone of the spout body is arranged to physically interact with the final zone of the spout counterpart.

In the final position of the spout, an outlet opening arranged on the spout is open, providing a liquid communication through the spout body to and through the outlet opening. In the loading position of the spout, the spout is arranged to prevent the fluid communication to and/or through outlet opening at least until the spout has been in its final position at least once. The spout features a barrier arranged along a movement path of the spout body from the loading position to the final position, and the barrier is arranged to provide physical resistance against a movement of the spout body from the loading position to the final position at least until the spout has been in its final position at least once.

Optionally, the loading zone of the spout counterpart and the final zone of the spout counterpart are free of mutual overlap.

The second aspect of the invention relates therefore to a spout as described in the first aspect, with a loading position and final position—but with only one configuration instead of two. The description of features in the first aspect of the invention apply to the second aspect of the invention as well.

According features and advantages of the spout of the first aspect of the invention (for example stoppers, guiding components, seals, functional elements and/or arrangement of zones) can be applied to the spout of the second aspect of the invention.

The loading position allows to load the spout, without to open the liquid communication (which happens in the final position). The spout is therefore tamperproof in the sense that tampering with the content of the container can be prevented. Also quality control of the quality of the container content is possible this way.

An advantage of a spout including a loading position and a final position is a possibility of arranging a release chamber in the spout.

As an optional feature, the spout includes a release chamber, which is arranged on the spout body, the spout counterpart and/or separate from the spout body and the spout counterpart. At least until the spout has been in its final position at least once, the release chamber is arranged to be closed and to contain a release material. The spout is furthermore arranged such that at least at a first change of the spout from the loading position to the final position, the release chamber is opened due to the change to the final position and the release chamber can release the release material.

The spout can be arranged such that the release chamber releases its release content into the outlet opening.

For example, the release chamber contains a liquid such as a sterilizer. The sterilizer is released only after the spout position changes from the loading position to the final position. This means that the sterilizer is released on a specifically chosen moment in time, for example just before using the container content for the first time or when connecting the spout to a specific receptacle. This way, the sterilizer is able to sterilize at least partially the outlet opening and/or elements further downstream (like a receptacle and/or a functional element). In other words, the spout including the release chamber allows to sterilize the spout and/or further elements at least partially at first use, but not during storage and transport.

The release material can, for example, be a priming liquid for priming a functional element. Priming means here a preparation of the functional element in order to bring it in a functional state. In case the functional element is the mixing unit, the priming liquid can for example prime the mixing unit which means that the mixing chamber is brought into a functional state by introducing the priming liquid into the mixing chamber in a predefined quantity at a predefined location. The mixing unit in an empty state does not function as efficiently as the mixing unit in a state where the priming liquid is introduced in it.

Optionally, the spout features a tightness element. The tightness element is, for example, arranged in a tightness zone of the spout.

The tightness element tightens i.e. seals the spout body against the spout counterpart when the spout is in its final position. In other words, the spout body and the spout counterpart are sealed in the tightness zone when the spout is in its final position. A water tight fluid communication through the spout is created by the tightness element.

The spout can feature a tightness element in radial direction and/or a tightness element in axial direction (with respect to a movement direction of the spout from the loading position to the final position).

In general, referring to all spout described above (including the first aspect of the invention and the second aspect of the invention): a spout with an inverse arrangement of the elements as described above is also possible. This means that the elements on the spout body can also be arranged on the spout counterpart while the elements of the spout counterpart are arranged on the spout body. Elements interacting with each other but arranged on different spout parts can be arranged in the way as described above or in an inverted manner i.e. the elements interacting with each other can switch a position on the one spout part with a position on the other spout part and vice versa.

As an example, the final zone can be arranged on the spout body, and the first zone can be arranged on the spout counterpart.

BRIEF DESCRIPTION OF THE DRAWINGS

The subject matter of the invention will be explained in more detail in the following text with reference to exemplary embodiments which are illustrated in the attached drawings, in which.

DETAILED DESCRIPTION OF THE INVENTION

Figure 1:
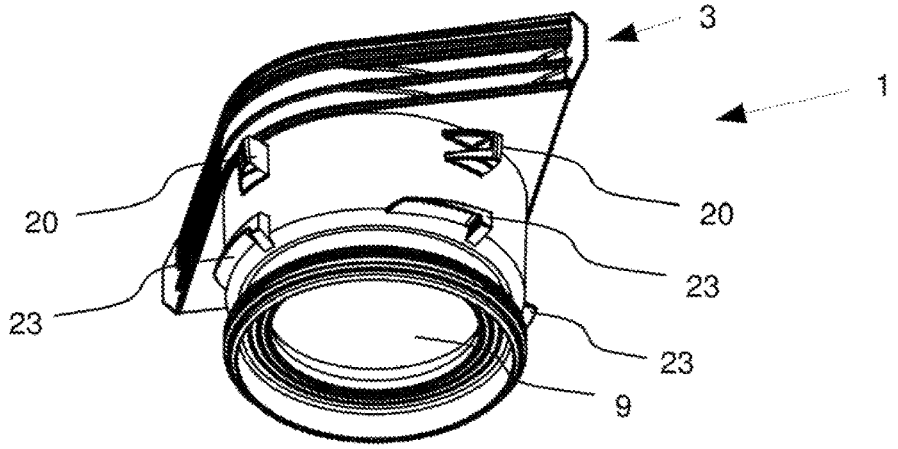
FIG. 1 schematically shows a spout body in perspective view.

In principle, identical parts are provided with the same reference symbols in the figures.

The described orientations and indicated directions in the text below refer to a paper surface for the case that the drawings are printed on paper. For example, "on top" or "higher" means being situated close or closer to a top edge of the paper with the drawing. In an analogue manner, "right" means close or closer to a right edge of the paper with the drawing.

Figure 2:
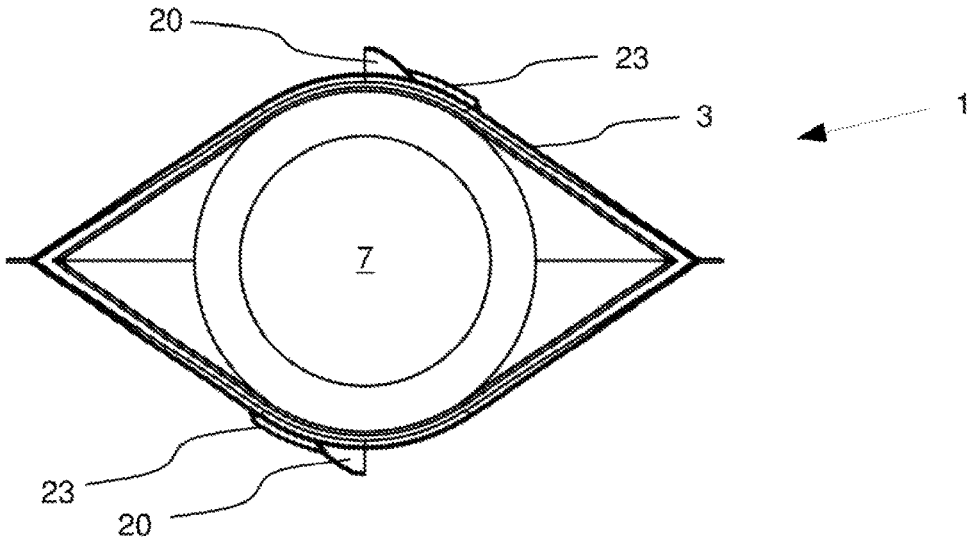
FIG. 2 shows the spout body from FIG. 1 in top view.

FIG. 1 schematically shows a spout body 1 in perspective view. FIG. 2 shows the same spout body 1 as in FIG. 1 but in top view, and FIG. 3 shows the same spout body 1 as in FIGS. 1 and 2 in side view.

The spout body 1 is produced from plastic and features essentially a shape of a hollow cylinder with some elements added on an outside of the hollow cylinder. As shown in FIGS. 1 and 3, the spout body 1 features at the top end of its hollow cylinder a container fastening part 3. The container fastening part 3 is an element featuring a surface where according surfaces of a container can be fixed, preferably by plastic welding in the case of a plastic container.

The container fastening part 3 features two triangular shaped protrusions extending radially from the hollow cylinder of the spout body 1. As shown in FIG. 2, a tip of each triangular shaped protrusion points away from the spout body 1, once to the right side and once to the left side. In other words, the container fastening part 3 features two spike shaped protrusions which are arranged on the spout body 1 in a symmetric manner (rotation symmetric for rotations of 180 degrees).

Figure 3:
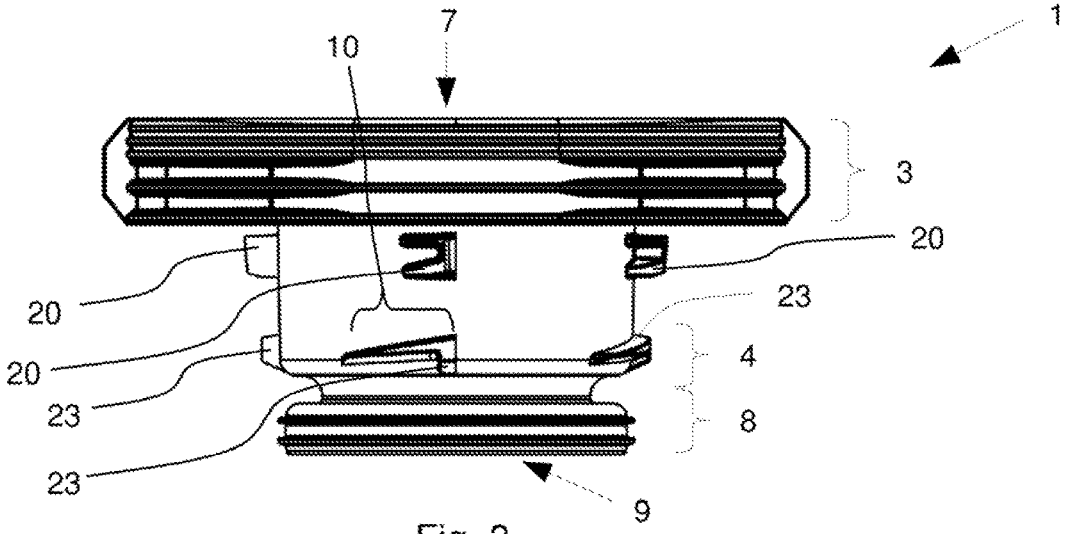
FIG. 3 shows the spout body from FIG. 1 in side view.

The spout body 1 features at the lower end of its hollow cylinder a tightness zone 8, and adjacent on top of it the first zone 4, as best seen in FIG. 3. The tightness zone 8 tightens the spout body 1 against the spout counterpart 2 when the spout is in its final position, and therefore a water tight fluid communication through the spout is created. The tightness zone 8 features two tightness elements in radial direction and one tightness element in axial direction (with respect to the essentially hollow cylinder shape of the spout body 1). A part of the outlet opening 7 of the spout is the empty inner part of the essentially hollow cylinder shaped spout body 1. In the region of the tightness zone 8, a seal 9 seals the empty inner part of the hollow cylinder shaped spout body 1.

The spout body 1 features four final configurations stoppers 20 and four protrusions 23. The final configurations stoppers 20 are positioned like in a ring around the hollow spout body, with an equidistant positioning (rotation symmetric for rotations of 90 degrees). The protrusions 23 are positioned the same way as the final configuration stoppers 20 (like in a ring and rotation symmetric for rotations of 90 degrees). As shown in FIGS. 1 and 3, the final configuration stoppers 20 are positioned below the container fastening part 3, and the protrusions 23 below the final configuration stoppers 20. The protrusions 23 are positioned in the first zone 4. One of the protrusions 23 is the reference subzone 10 of the spout body 1.

Figure 4:
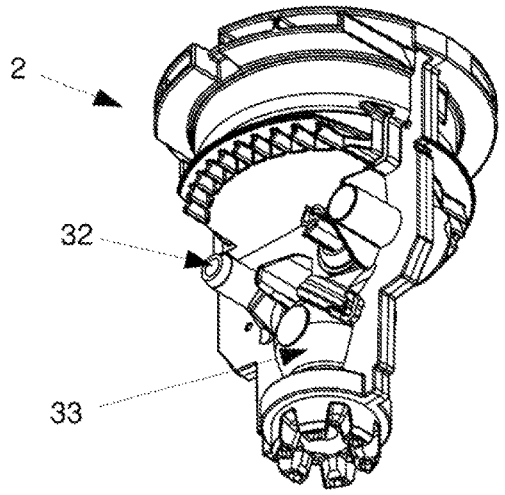
FIG. 4 schematically shows a spout counterpart in perspective view.
Figure 5:
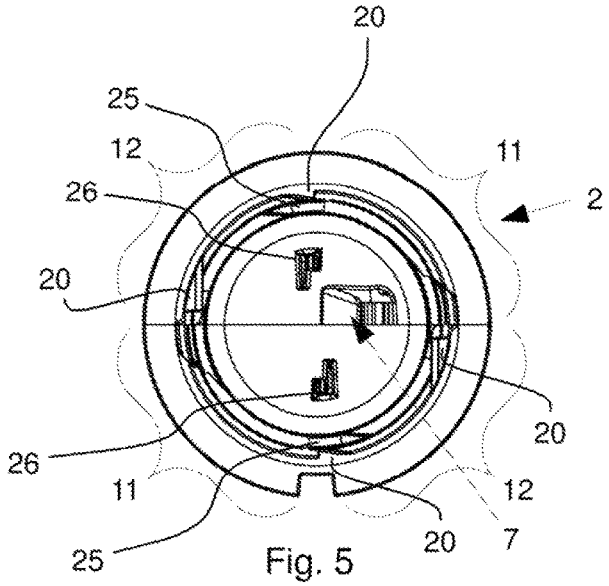
FIG. 5 shows the spout counterpart from FIG. 4 in top view.
Figure 6:
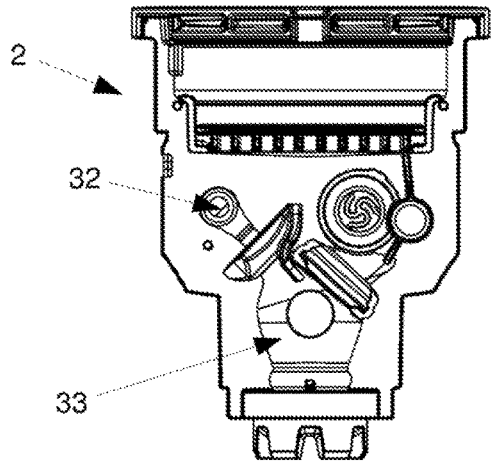
FIG. 6 shows the spout counterpart from FIG. 4 in side view.
Figure 7:
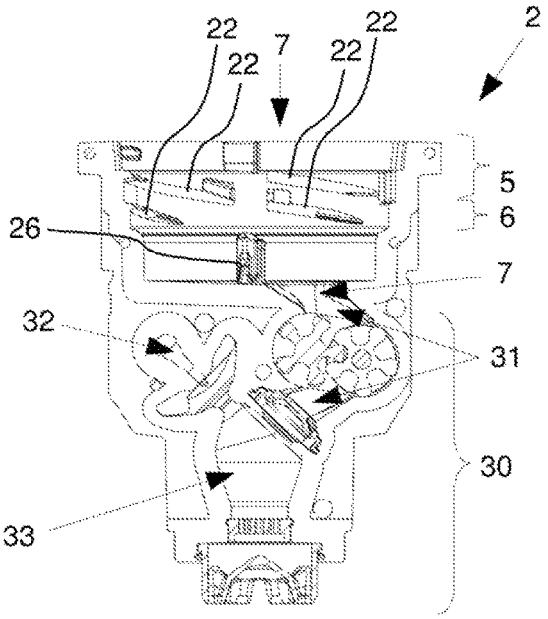
FIG. 7 shows a cut through the spout counterpart from FIG. 4 in the same side view as FIG. 6.

FIG. 4 schematically shows a spout counterpart 2 in perspective view. FIG. 5 shows the same spout counterpart 2 as in FIG. 4 but in top view, and FIG. 6 shows the same spout counterpart 2 as in FIGS. 4 and 5 in side view. FIG. 7 shows a cut through the spout counterpart 2 from FIG. 4 in the same side view as FIG. 6.

The spout counterpart 2 is produced from plastic and features essentially a shape of a hollow cylinder in the region of its loading zone 5 and its final zone 6 (as best seen in FIGS. 6 and 7), with some elements added on an inside of the hollow cylinder in these regions. In FIGS. 4, 6 and 7, the loading zone 5 is at the top end of the hollow cylinder shape of the spout counterpart 2. The final zone 6 is positioned below the loading zone 5 in these figures, and a functional element 30 is positioned below the loading zone 5 (and below the hollow cylinder shaped part of the spout counterpart 2—the functional element 30 is not essentially shaped as a hollow cylinder).

FIG. 5 shows in top view at an end of the hollow cylinder shaped part of the spout counterpart that the outlet opening 7 is an opening arranged asymmetrically in the hollow cylinder shape. The outlet opening 7 is shifted to the top and to the right with respect to a longitudinal axis of the hollow cylinder part of the spout counterpart 2. The outlet opening 7 is also tilted with respect to the longitudinal axis of the hollow cylinder part, as seen in FIG. 7.

The outlet opening 7 leads to a liquid duct 31 of the functional element 30 of the spout counterpart 2. The liquid duct 31 is therefore arranged downstream of the outlet opening 7. The liquid duct 31 ends up in a mixing chamber 33, and also a diluent duct 32 ends up in the mixing chamber 33 (best seen in FIG. 7). A diluent stream from the diluent duct 32 intersects with a liquid stream from the liquid duct 31 at the mixing chamber 33.

The spout counterpart 2 features two seal openers 26 arranged at the lower end of the hollow cylinder part of the spout counterpart 2 in FIG. 7. They point upwards and are shaped in a manner to cut and shear open the seal 9 of the spout body 1 once the spout is moved into is final position.

The spout counterpart 2 further includes four final configuration stoppers 20 which in order to work as final configurations stoppers interact with the final configuration stoppers 20 of the spout body 1. Also shown in FIG. 5 are elements functioning as barrier 25, i.e., they have to be overcome by the reference zone 10 of the spout body 1 in order to change from the loading position to the final position.

As the spout body 1 is rotation symmetric with respect to a rotation of 180 degrees, the reference zone 10 of the spout body 1 can end up in two zones arranged opposite to each other on the spout counterpart 2 while being in the same configuration. Therefore, FIG. 5 shows two first subzones 11 of the final zone 6 of the spout counterpart 2, and these two first subzones 11 are situated opposite to each other. The same goes for the two second subzones 12 of the final zone 6 of the spout counterpart 2. These two second subzones 12 of the final zone 6 are lying between the two first subzones 11 of the final zone 6. Each one of these four subzones 11, 12 of the final zone 6 extend over a quarter of a circumference of the hollow cylinder shape of the spout counterpart 2. If the reference subzone 10 of the spout body 1 is in physical interaction with one of the two first subzones 11 of the final zone 6 of the spout counterpart 2, then the spout in its final position is in its first configuration. The same is valid in an analog manner for the second subzones 12 and the second configuration.

Also visible in FIG. 7 are guiding elements 22, allowing to move the spout body 1 in a rotational, screwing like movement relative to the spout counterpart 2.

Figure 8:
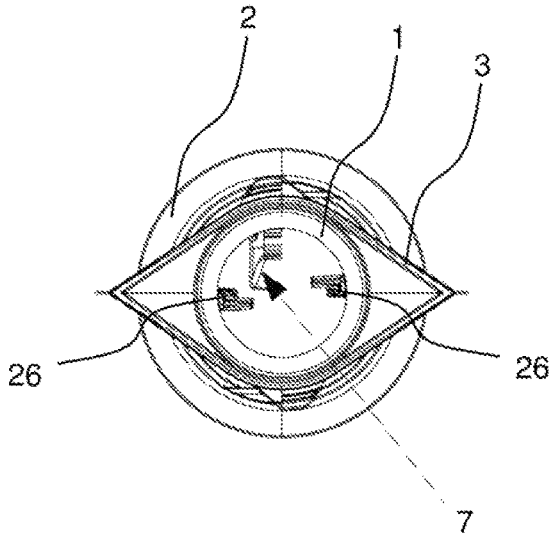
FIG. 8 schematically shows the spout body from FIG. 1 with the spout counterpart from FIG. 4 in the final position in the first configuration in top view.
Figure 9:
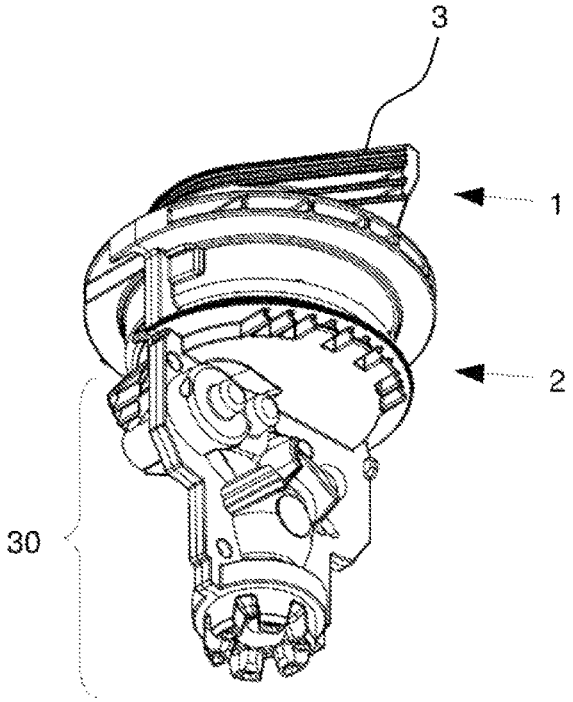
FIG. 9 shows the spout from FIG. 8 in perspective view.

FIG. 8 schematically shows the spout body 1 from FIG. 1 with the spout counterpart 2 from FIG. 4 in the final position in the first configuration in top view, and FIG. 9 shows the same in perspective view.

Figure 10:
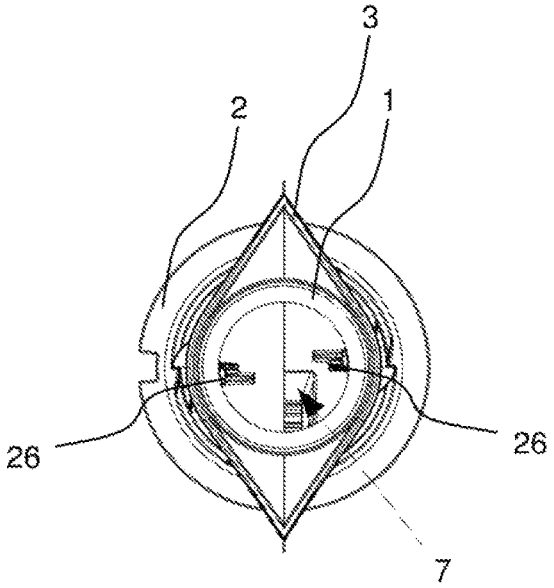
FIG. 10 schematically shows the spout body from FIG. 1 with the spout counterpart from FIG. 4 in the final position in the second configuration in top view.
Figure 11:
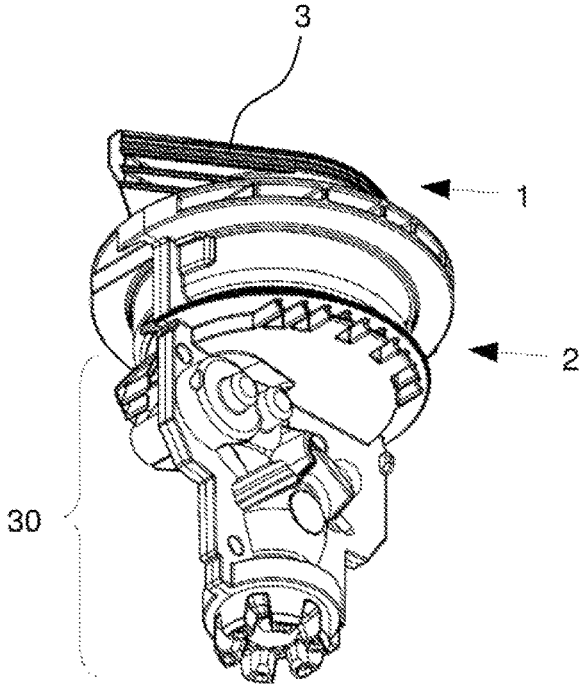
FIG. 11 shows the spout from FIG. 10 in perspective view.

FIG. 10 on the other hand schematically shows the spout body 1 from FIG. 1 with the spout counterpart 2 from FIG. 4 in the final position in the second configuration in top view (and FIG. 11 shows the same in perspective view).

The spout counterpart 2 in FIGS. 8 and 10 are drawn in the exactly the same orientation (the same goes for FIGS. 9 and 11). The spout body 1 on the other hand is rotated around 90 degrees between the two different configurations of the final position, as seen by the orientation of the container fastening part 3 of the spout body 1 when comparing FIGS. 8 and 10 (or 9 and 11).

The spout consisting of spout body 1 and spout counterpart 2 is used in one embodiment to be plastic welded to container which is a flexible plastic pouch containing liquid soap. The soap container is used in a hand washing device, so the spout with its functional element 30 is connected to the washing device, and the washing device features therefore a receptacle to be connected to the spout. As the washing device exists in two different embodiments named first type and second type, the soap container is placed, for example due to spatial restrictions and/or due to a specific type of integration (for example, due to different receptacles) in different ways in the respective washing devices. Therefore, the spout needs to be for example oriented in different ways for the different types of the washing station: either the spikes of the container fastening part 3 pointing to the right and to the left as in the first configuration of the final position shown in FIG. 8, or the spikes of the container fastening part 3 pointing upwards and downwards as in the second configuration of the final position shown in FIG. 10.

Advantageously, the same container with the same spout can be used for both types of washing devices due to the two different configurations.

Figure 12:
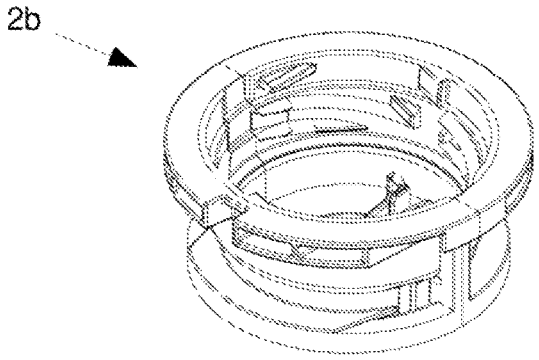
FIG. 12 schematically shows a spout counterpart without a functional element, like in FIG. 4 in perspective view.
Figure 13:
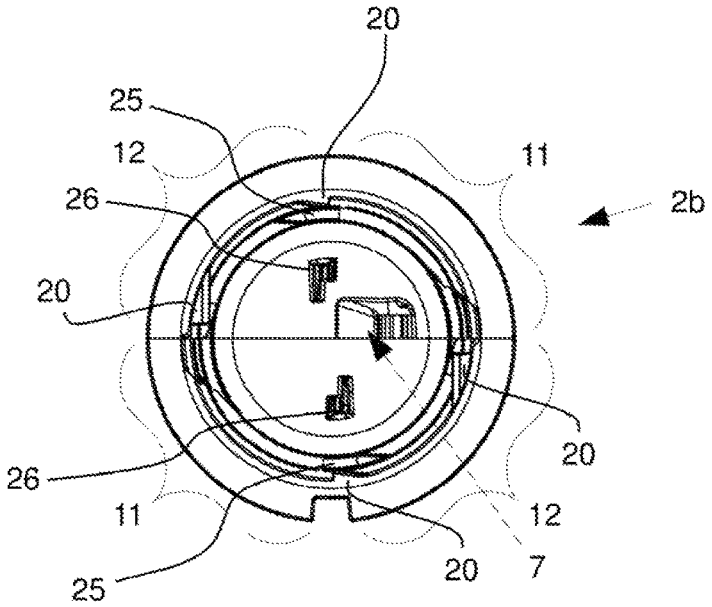
FIG. 13 shows the spout counterpart from FIG. 12 in top view.
Figure 14:
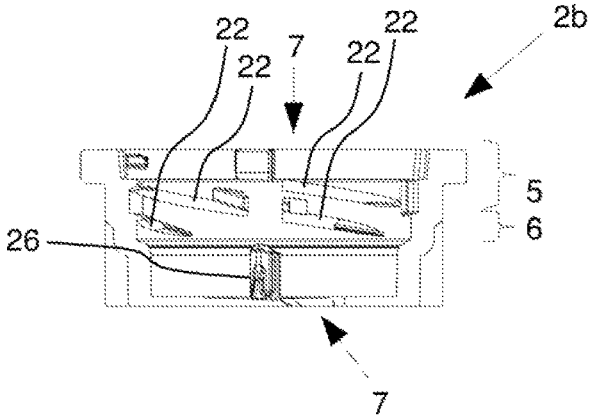
FIG. 14 shows the spout counterpart from FIG. 12 in side view.

The spout counterpart 2 in the FIGS. 4 to 7 (and also in FIGS. 8 to 11 shown together with the spout body 1) includes the functional element 30. An analogue spout counterpart **2*b* without any functional element is shown in FIGS. 12 to 14. Besides that the spout counterpart 2*b* in FIG. 12 is realized without a functional element, it is the same as the spout counterpart 2 in FIG. 4. The same goes for FIG. 13 with respect to FIG. 5 and for FIG. 14 with respect to FIG. 6**.

Figure 15:
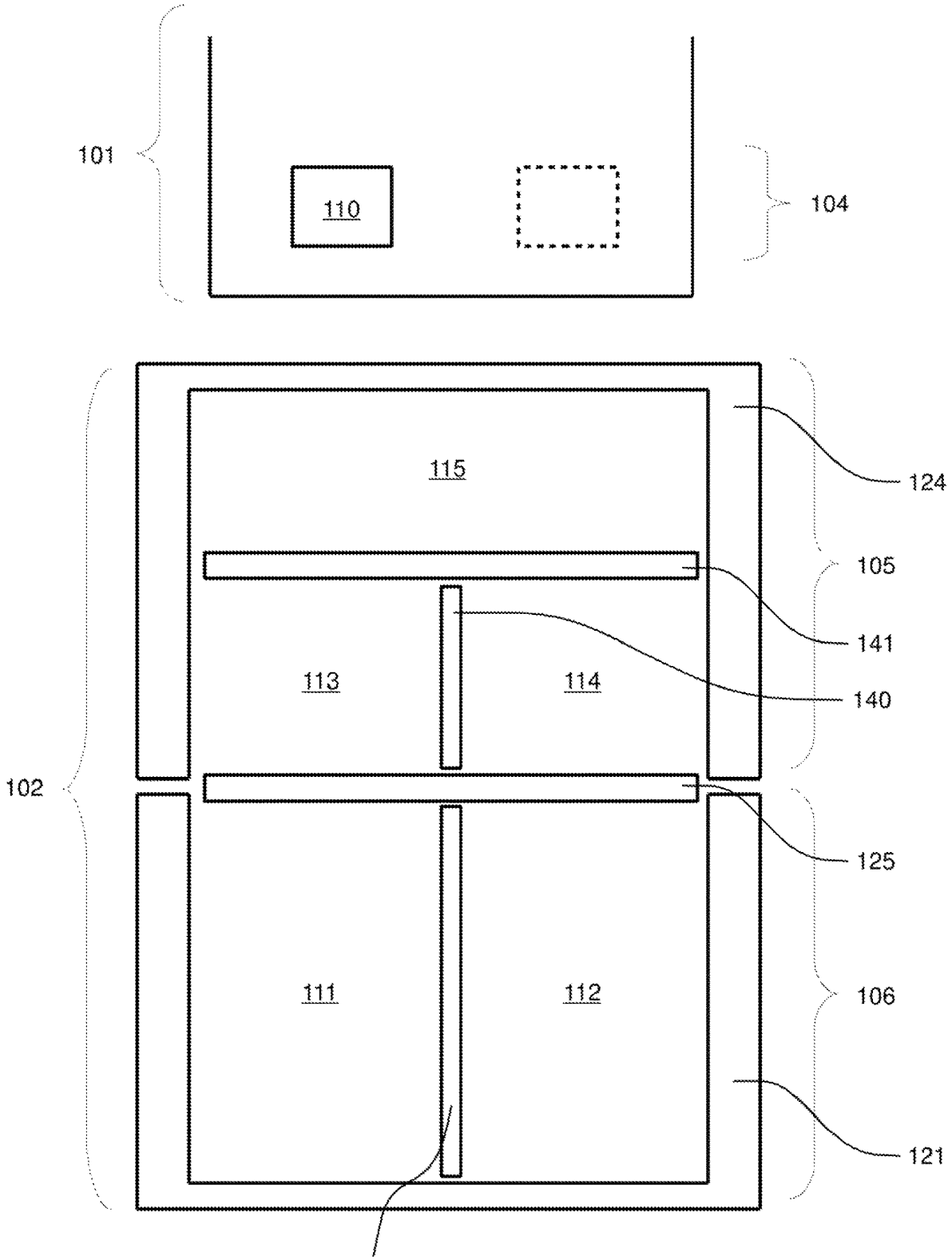
FIG. 15 schematically shows a strongly simplified arrangement of zones, barriers and stoppers.

FIG. 15 schematically shows a strongly simplified arrangement of zones, barriers and stoppers in order to better illustrate their functioning. FIG. 15 shows selected parts of a spout in side view. The spout body 101 features a reference subzone 110 within the first zone 104 of the spout body 101. In FIG. 15, the spout body 101 is shown separated from the spout counterpart 102 and arranged on top of it. The reference subzone 110 can be arranged as shown in solid lines in FIG. 15—in this position, a downwards movement of the spout body 1 would eventually bring the spout in a first configuration of the final position. The reference subzone 110 would then be arranged in FIG. 15 within the first subzone 111 of the final zone 106 of the spout counterpart 102.

The reference subzone 110 can be also arranged as shown in interrupted lines in FIG. 15 (in a position on right hand side of the position described above)—in this position, a downwards movement of the spout body 1 would eventually bring the spout in a second configuration of the final position. The reference subzone 110 would then be arranged in FIG. 15 within the second subzone 112 of the final zone 106 of the spout counterpart 102.

The spout counterpart 102 features a loading zone 105, a final zone 106 below the loading zone 105 and a barrier 125 between the loading zone 105 and the final zone 106. Within the loading zone 106, the first subzone 111 of the final zone 106 is separated from the second subzone 112 of the final zone 106 by the final configuration stopper 120. The final configuration stopper 120 prevents the reference subzone 110 to move directly from the first subzone 111 of the final zone 106 to the second subzone 112 of the final zone 106 and vice versa.

Around the first subzone 111 and the second subzone 112 of the final zone 106 extends a final zone stopper 121. The final zone stopper 121 prevents the reference subzone 110 to leave the final zone 106 with exception when leaving through the barrier 125.

The loading zone 105 of the spout counterpart 102 features a first subzone 113 of the loading zone 105 which is separated from a second subzone 114 of the loading zone 105 by a loading configuration stopper 140. The loading configuration stopper 140 has the same function for the loading zone 105 as the final configuration stopper 120 for the final zone: the loading configuration stopper 140 prevents the reference subzone 110 to move directly from the first subzone 113 of the loading zone 105 to the second subzone 114 of the loading zone 105 and vice versa.

A loading zone barrier 141 is positioned directly on top of the first subzone 113 of the loading zone 105 and the second subzone 114 of the loading zone 105. The loading zone barrier 141 separates the first subzone 113 and second subzone 114 of the loading zone 105 from a switching subzone 115 of the loading zone 105. The loading zone barrier 141 is arranged to word in an analogue manner as the barrier 125 between loading zone 105 and final zone 106, but now between the switching subzone 115 on one hand and the first subzone 113 and the second subzone 114 of the loading zone 106 on the other hand. In the switching subzone 115, the reference subzone 110 can be brought into different positions which either allow the reference subzone 110 to be moved into the first subzone 113 or the second subzone 114 of the loading zone 105.

While the invention has been described in present embodiments, it is distinctly understood that the invention is not limited thereto, but may be otherwise variously embodied and practised within the scope of the claims.

The invention claimed is:

1. A spout for a container, wherein the spout comprises a spout body and a spout counterpart, and wherein the spout body features a container fastening part, and wherein the spout body comprises a first zone being an integral part undetachable from the spout body, and wherein the spout counterpart comprises a final zone being an integral part undetachable from the spout counterpart, and wherein the spout body and the spout counterpart are spatially arrangeable with respect to each other in a final position of the spout, wherein in the final position of the spout, the first zone of the spout body is arranged to physically interact with the final zone of the spout counterpart, and wherein in the final position of the spout, an outlet opening arranged on the spout is open, providing a liquid communication through the spout body to and through the outlet opening, wherein the spout features a final configuration stopper and wherein the final zone of the spout counterpart features a first subzone and a second subzone, the first subzone being arranged free of mutual overlap with the second subzone, allowing the spout to be arranged in the final position in two different configurations:

a first configuration of the final position, where a reference subzone of the first zone of the spout body is arranged to physically interact with the first subzone of the final zone of the spout counterpart, and the final configuration stopper is arranged to provide physical resistance against a movement of the reference subzone of the first zone of the spout body from the first subzone of the final zone of the spout counterpart to the second subzone of the final zone of the spout counterpart, and a second configuration of the final position, where the reference subzone of the first zone of the spout body is arranged to physically interact with the second subzone of the final zone of the spout counterpart, and the final configuration stopper is arranged to provide physical resistance against a movement of the reference subzone of the first zone of the spout body from the second subzone of the final zone of the spout counterpart to the first subzone of the final zone of the spout counterpart, wherein the spout counterpart features a functional element in fluid communication with the outlet opening of the spout counterpart, the functional element being arranged downstream of the outlet opening with regard to a stream direction of the fluid communication from the spout body to the outlet opening, wherein the functional element, in the final position of the spout, is arranged to influence the liquid communication downstream of the outlet opening.

2. The spout according to claim 1, wherein the functional element is arranged to add a substance into the liquid communication in the final position of the spout.

3. The spout according to claim 2, wherein the functional element is a mixing unit comprising a liquid duct in liquid communication with the liquid communication through the spout, a diluent inlet with a diluent duct, and a mixing chamber for mixing the liquid with the diluent, wherein the diluent duct is positioned relatively to the liquid duct for a diluent stream to intersect a liquid stream before or at the mixing chamber.

4. The spout according to claim 1, wherein the spout counterpart comprises a loading zone being an integral part undetachable from the spout counterpart, wherein the spout body and the spout counterpart are spatially arrangeable with respect to each other in a loading position of the spout, wherein in the loading position of the spout, the first zone of the spout body is arranged to physically interact with the loading zone of the spout counterpart, and wherein in the loading position of the spout, the reference subzone of the first zone of the spout body is able to be repositioned from a first position in the loading zone leading to the first configuration of the final position to a second position in the loading zone leading to the second configuration of the final position.

5. The spout according to claim 4, wherein the spout features a barrier arranged along a movement path of the spout body from the loading position to the final position, and the barrier is arranged to provide physical resistance against a movement of the spout body from the loading position to the final position at least until the spout has been in the final position at least once.

6. The spout according to claim 5, wherein, if the spout is in the loading position, the spout features a loading zone stopper that is arranged to provide physical resistance against a movement of the reference subzone of the first zone of the spout body beyond the loading zone of the spout counterpart, with an exception of the loading zone stopper being arranged to provide no physical resistance against a movement from the loading zone to the final zone.

7. The spout according to claim 6, wherein the barrier is arranged to provide a physical resistance against a movement which is lower than the physical resistance of the loading zone stopper.

8. The spout according to claim 4, wherein, if the spout is in the loading position, the spout is arranged to provide physical resistance against any movement of the reference subzone of the first zone of the spout body beyond the loading zone of the spout counterpart, with exception of a movement from the loading zone to the final zone.

9. The spout according claim 5, wherein the spout features a loading configuration stopper and wherein the loading zone of the spout counterpart features a first subzone and a second subzone, the first subzone of the loading zone being arranged free of mutual overlap with the second subzone of the loading zone, allowing the spout to be arranged in the loading position in two different loading configurations:

a first loading configuration of the loading position, where the reference subzone of the first zone of the spout body is arranged to physically interact with the first subzone of the loading zone of the spout counterpart, and the loading configuration stopper is arranged to provide physical resistance against a movement of the reference subzone of the first zone of the spout body from the first subzone of the loading zone of the spout counterpart to the second subzone of the loading zone of the spout counterpart, and a second loading configuration of the loading position, where the reference subzone of the first zone of the spout body is arranged to physically interact with the second subzone of the loading zone of the spout counterpart, and the loading configuration stopper is arranged to provide physical resistance against a movement of the reference subzone of the first zone of the spout body from the second subzone of the loading zone of the spout counterpart to the first subzone of the loading zone of the spout counterpart, wherein the spout in the first loading configuration of the loading position is arranged to be moved to the first configuration of the final position if overcoming the physical resistance of the barrier, and is arranged to be prevented to be moved to the second configuration of the final position if overcoming the physical resistance of the barrier.

10. The spout according to claim 1, wherein the spout features a final zone stopper that is arranged to provide physical resistance against a movement of the reference subzone of the first zone of the spout body beyond the final zone of the spout counterpart, if the spout is in the final position.

11. The spout according to claim 10, wherein, if the spout is in the final position, the spout is arranged to provide physical resistance against any movement of the reference subzone of the first zone of the spout body beyond the final zone of the spout counterpart.

12. The spout according to claim 1, wherein the first zone of the spout body and the final zone of the spout counterpart feature guiding components defining a helical movement path of the spout body relative to the spout counterpart in a movement into the final position of the spout.

13. The spout according claim 1, wherein the spout features a spout seal arranged at the spout to prevent the fluid communication to and/or through the outlet opening at least until the spout has been in the final position at least once.

* * * * *